US009351547B2

(12) United States Patent
Pilliod

(10) Patent No.: US 9,351,547 B2
(45) Date of Patent: May 31, 2016

(54) FERROUS ALLOY FOR COINING AND METHOD FOR PRODUCING THE SAME

(71) Applicant: CRS Holdings Inc., Wilmington, DE (US)

(72) Inventor: Christopher F. Pilliod, Sinking Springs, PA (US)

(73) Assignee: CRS Holdings Inc., Wilmington, DE (US)

( * ) Notice: Subject to any disclaimer, the term of this patent is extended or adjusted under 35 U.S.C. 154(b) by 385 days.

(21) Appl. No.: 13/793,183

(22) Filed: Mar. 11, 2013

(65) Prior Publication Data

US 2014/0250966 A1 Sep. 11, 2014

(51) Int. Cl.

| | |
|---|---|
| ***C22C 38/42*** | (2006.01) |
| ***C21D 8/00*** | (2006.01) |
| ***C21D 7/00*** | (2006.01) |
| ***A44C 21/00*** | (2006.01) |
| ***C22C 1/02*** | (2006.01) |
| ***C22C 38/58*** | (2006.01) |
| ***C22C 38/34*** | (2006.01) |
| ***B21B 1/02*** | (2006.01) |
| ***B21D 19/00*** | (2006.01) |
| ***B21D 28/02*** | (2006.01) |
| ***B24B 1/00*** | (2006.01) |
| ***C21D 6/00*** | (2006.01) |
| ***C22C 38/02*** | (2006.01) |
| ***C22C 38/04*** | (2006.01) |

(52) U.S. Cl.

CPC ..... *A44C 21/00* (2013.01); *B21B 1/026* (2013.01); *B21D 19/00* (2013.01); *B21D 28/02* (2013.01); *B24B 1/00* (2013.01); *C21D 6/004* (2013.01); *C22C 1/02* (2013.01); *C22C 38/02* (2013.01); *C22C 38/04* (2013.01); *C22C 38/34* (2013.01); *C22C 38/42* (2013.01); *C22C 38/58* (2013.01)

(58) Field of Classification Search

None

See application file for complete search history.

(56) References Cited

U.S. PATENT DOCUMENTS

| | | | |
|---|---|---|---|
| 2,449,023 | A | 9/1948 | Thornton |
| 2,523,000 | A | 9/1950 | Defranoux |
| 2,775,520 | A | 12/1956 | Bloom et al. |
| 3,083,095 | A | 3/1963 | Tanczyn |
| 4,049,430 | A | 9/1977 | Myers |
| 4,097,311 | A | 6/1978 | Ishibashi et al. |
| 4,999,159 | A | 3/1991 | Uematsu et al. |
| 5,614,149 | A | 3/1997 | Abe et al. |
| 5,686,044 | A | 11/1997 | Ikegami et al. |
| 2010/0102910 | A1 | 4/2010 | Waeckerle et al. |

FOREIGN PATENT DOCUMENTS

| | | | |
|---|---|---|---|
| CN | 101608286 | A | 12/2009 |
| GB | 692419 | A | 3/1953 |
| GB | 1549338 | A | 1/1979 |
| JP | 4066651 | A | 3/1992 |
| JP | 05117815 | A | 5/1993 |
| JP | 0770714 | A | 3/1995 |
| JP | 8053738 | A | 2/1996 |
| JP | 10140295 | A | 5/1998 |
| JP | 2000282192 | A | 10/2000 |
| JP | 2005213589 | A | 8/2005 |
| JP | 2007100147 | A | 4/2007 |
| JP | 2008308705 | A | 12/2008 |

OTHER PUBLICATIONS

PCT Notification, Search Report and Written Opinion, International Application No. PCT/US2014/023314, dated Aug. 14, 2014, 14 pages.

2012 Biennial Report to the Congress on the Current Status of Coin Production Costs and Analysis of Alternative Content, United States Mint, Department of the Treasury, Dec. 2012, 8 pages.

PCT International Preliminary Report dated Sep. 15, 2015, issued in co-pending International Application No. PCT/US2014/023314. 10 pages.

*Primary Examiner* — Deborah Yee

(74) *Attorney, Agent, or Firm* — Barley Snyder

(57) ABSTRACT

A ferrous alloy is provided for coining The ferrous alloy includes a composition of: 4.00-10.80 wt % of chromium (Cr), 8.00-25.00 wt % of nickel (Ni), 3.00-6.00 wt % of copper (Cu), and a balance of iron (Fe) and incidental impurities.

23 Claims, No Drawings

FERROUS ALLOY FOR COINING AND METHOD FOR PRODUCING THE SAME

FIELD OF THE INVENTION

The present invention relates to an alloy composition for coining, in particular, to a ferrous alloy for coining, and a method for producing the alloy composition.

BACKGROUND OF THE INVENTION

In the United States, the five-cent coin is currently prepared from a standard composition of 75% copper (Cu) and 25% nickel (Ni) by weight. The United States Mint has employed this composition since the inception of the five-cent piece in 1866. The standard composition provides properties that balance the needs of commerce while offering acceptable wear resistance with sufficient coinability to optimize die life during coin manufacturing. Additionally, and importantly, this composition also provides electromagnetic properties which are relied upon by the vending and banking industries.

While the combination of Cu and Ni have provided desirable properties for U.S. currency, both Cu and Ni have been subject to dramatic increases and fluctuations in cost during recent years, with the cost of raw metals exceeding the face value of the five-cent coin itself.

In 2012, the U.S. Mint reported that the total raw material cost for each five-cent coin was $0.06, with total production costs being $0.1009 per five cent coin. As a result, the financial implications have prompted legislation for an alternative to the current standard composition. At the same time, it is desired that critical-to-performance properties, such as wear resistance, coinability, corrosion resistance, and electromagnetic properties among others be maintained.

Stainless steels have been proposed as alternative materials for coining, since the base metal cost of iron is significantly less than Cu, and iron is readily available and less susceptible to price fluctuations. A popular example is type 430 stainless steel, currently being utilized as a coining and token alloy by some private and foreign mints.

However, 430 and other stainless alloys may lack characteristics desired by discriminating producers, including difficulty in striking, magnetic properties and so on. Foreign mints utilizing stainless alloys for coining attempt to circumvent premature die wear through design. In particular, these mints design images and lettering exhibiting shallow relief, or design, to facilitate striking of the coin and thus avoiding premature wear of the die. United States coinage tends to display deeper designs, which necessitate larger striking forces, leading to potentially decreases in die life.

Another problem with 430 and other stainless alloys is by nature they are ferromagnetic, which may considered be a detriment for coinage in the United States. For many foreign countries and the gaming industry magnetism is not considered an impairment for exclusion.

As a result, there is a desire for a new alloy for coining that utilizes significantly more cost effective raw materials and retains much of the desired properties of the known composition, such as wear resistance, strikability, corrosion resistance, and electromagnetic properties.

SUMMARY OF THE INVENTION

The present invention was made in view of the above-mentioned issues and is directed toward a ferrous alloy for coining.

The ferrous alloy includes 4.00-10.80 wt % of chromium (Cr), 8.00-25.00 wt % of nickel (Ni), 3.00-6.00 wt % of copper (Cu), and a balance of iron (Fe) and incidental impurities.

DETAILED DESCRIPTION OF THE INVENTION

The invention is a ferrous alloy for coining that has desirable material properties, such as wear resistance, coinability, and corrosion resistance required for United States coining The ferrous alloy according to the invention includes a composition of chromium (Cr), nickel (Ni), copper (Cu), and a base metal of iron (Fe). In particular, in an exemplary embodiment of the invention, the ferrous alloy includes a proportion of 4.00-10.80 wt % of Cr, 8.00-25.00 wt % of Ni, and 3.00-6.00 wt % of Cu, with a base metal of Fe completing the composition.

In the known composition for the five-cent coin, Cu is used as the base metal. Since Cu is a high priced raw material, the overall cost of the known composition is high. As an alternative, Fe offers significant economical advantages over Cu as the base metal with less pricing fluctuations. Furthermore, Fe provides the desired wear resistance properties seen in the known five-cent coin composition.

In the proposed ferrous alloy composition, chromium is used at 4.00-10.80 wt % to provide desired corrosion resistant properties. While Cr is generally used in a stainless alloy composition, generally the known composition prefers having Cr at or above 18 wt % for Cr. In fact, it is well-known that Cr should not be used below 12 wt % in known stainless applications, considering that Cr experiences linear degradation below 12 wt %, which is generally not desired in known stainless alloy compositions.

In the proposed ferrous alloy composition, Cu is used to enhance metal flow during coining and, in particular, during striking of a blank prepared from the ferrous alloy composition. While Cu is a higher priced raw material, Cu is limited to 3.00-6.00 wt % in the proposed ferrous alloy composition, as compared to 75 wt % in the known composition for the known five-cent coin.

In the proposed ferrous alloy composition, Ni is also used to enhance metal flow enhance metal flow, insure non ferromagnetism, and aid in corrosion resistance. In particular, the parts of Ni are being reduced from 25 wt % in the known composition to 8.00-25.00 wt % in the proposed ferrous alloy composition according to the invention. It is well-known that a ferrous alloy will become magnetic once the parts of Ni is reduced to below 8.00 wt %.

With respect to the reduced level of Cr, the established targets and ratio of Ni and Cu are deemed such that while providing optimized metal flow characteristics to accommodate coining, Ni and Cu additionally provide additive enhancements with respect to corrosion resistance; with the cumulative alloying effect anticipated to offer appropriate serviceability in the range of environments which coinage experiences in standard commercial circulation.

In another exemplary embodiment of the invention, a ferrous alloy is prepared from a composition of 7.5-8.5 wt % of Cr, 14.50-15.50 wt % of Ni, 4.5-5.5 wt % of Cu, and a base metal of Fe completing the composition.

In yet another exemplary embodiment of the present invention, a ferrous alloy may include one or more elements in the ferrous alloy composition according to the invention, selected from a group consisting of 0.001-0.025 wt % of carbon (C), 0.50-2.00 wt % of manganese (Mn), and 0.001-2 wt % of silicon (Si).

In another exemplary embodiment of the invention, the ferrous alloy may inevitably incorporate other trace elements. Trace elements are understood to mean elements that are present at 0.1 wt % or less in the composition.

As combined, the ferrous alloy composition according to the invention is engineered such that the resulting ferrous alloy provides a yield strength of 21-25 ksi and, more specifically, a maximum yield strength of 25 ksi. Additionally, the ferrous alloy composition according to the invention is processed such that the resulting ferrous alloy has a minimum elongation of 40%.

Any of the aforementioned compositions of the ferrous alloy according to the invention are first processed into strip form to desired gauge, blanked to desired diameter and upset. Annealing after these operations is performed according to a prescribed procedure. For this invention it is imperative this order of operations be followed.

In an exemplary description of manufacturing, a ferrous alloy according to the invention is processed according to the following steps. However, one skilled in the art should appreciate that following steps are merely exemplary and used to enable one skilled in the art to process the proposed ferrous alloy compositions according to the invention.

Firstly, the ferrous alloy composition is measured according to the specifications defined above, and then subjected to a batch melting process, such as electric arc furnace (EAF) melting, in order to producing batches of molten alloy. The electric arc furnace operates the following exemplary cycle: (1) furnace charging, (2) melting, (3) refining, (4) de-slagging, (5) tapping, and (6) furnace turn-around. However, one skilled in the art should appreciate that other melting techniques are possible, including the use of a plasma arc furnace (PAF).

Next, the composition may be subjected to argon oxygen decarburization (AOD) processing, since the composition includes Cr. In this instance, after initial melting, the alloy is then transferred to an AOD vessel where it will be subjected to three steps of refining, including decarburization, reduction, and desulphurization.

Next, the molten metal is subject to continuous casting, whereby the molten ferrous alloy is solidified into a billet, a bloom, or a slab for subsequent rolling. In the exemplary embodiment, the molten ferrous alloy is cast into ingot slabs.

Each ingot slab is then subject to hot rolling at a prescribed temperature above the recrystallization point of the composition. In particular, the ingot slab comes from the continuous casting operation and then fed into the rolling mills at the appropriate temperature. After the grains deform during processing, they recrystallize, which maintains an equiaxed microstructure and prevents the present ferrous alloy from work hardening.

The ferrous alloy in this form is then subject to surface preparation, including but not limited to surface grinding. In particular, the ferrous alloy is finished using a rotating abrasive wheel to smooth the flat surface of ferrous alloy to remove imperfections. One skilled in the art should appreciate that other known surface preparation techniques may be used, such as abrasive blasting.

Next, the ferrous alloy is hot rolled to size. However, the finished hot roll gauge will be determined based upon the specified gauge of the denomination being produced. For example, the finish gauge of the U.S. five-cent piece is 0.0619". Therefore, in an exemplary embodiment, hot rolling for the five cent piece will be completed above a final target gauge of the particular coin, so that cold rolling can be performed to a more exacting finish gauge.

The ferrous alloy then undergoes a final surface preparation of the ferrous alloy slab using grinding techniques, and then cold rolled to the final target gauge. During cold rolling, the ferrous alloy according to the invention is rolled below its recrystallization temperature (i.e. room temperature). In addition to dimensional control, cold rolling also provides a uniform surface finish. The finished coil is then trimmed and cut to a specified width for processing of blanks The coil of ferrous alloy is then fed through a blanking press, which punches out round discs called blanks The blank presses utilize a bank of punches which travel downward through the strip of ferrous alloy into a steel bedplate which has holes corresponding to the punches. The presses punch out blanks with each downward cycle. The leftover webbing of ferrous alloy is shredded and recycled.

The blanks of ferrous alloy are slightly larger in diameter than the finished coins.

Each blank of ferrous alloy is then processed through an upsetting mill, which imparts a rim around the entire circumference of each blank. The upsetting mill consists of a rotating wheel with a groove on its edge, which fits into a curved section (or shoe) having a corresponding groove. During processing, the distance between the wheel and the shoe gets progressively narrower so that a raised rim is formed on each side as the blank of ferrous is rolled along the groove.

To optimize coinability the blanks of ferrous alloy must now be annealed Annealing insures that the ferrous blanks have reached a desired maximum hardness level so that they can be acceptably stuck to capture the full relief of the designs of the working dies. The annealing process involves heating the blanks, now planchets, above 1800 degrees to insure maximum Engineered Yield Strength of 25 ksi.

Despite protective measures and anti-tarnishing properties of the ferrous alloy, the annealing can cause some discoloration on the surfaces of the planchets which must be removed. As a result, blanks may be tumbled against each other and/or passed through a chemical bath. Planchet preparation is now complete and manufacturing of coins is the next process.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A ferrous alloy for coining, consisting essentially of:
4.00-9.85 wt % of chromium (Cr);
8.00-25.00 wt % of nickel (Ni);
3.00-6.00 wt % of copper (Cu);
0.001-0.025 wt % of C;
0.50-2.00 wt % of Mn;
0.001-2 wt % of Si; and
a balance of iron (Fe) and incidental impurities.

2. The ferrous alloy according to claim 1, wherein Ni is 14.50-15.50 wt %.

3. The ferrous alloy according to claim 2, wherein Cu is 4.5-5.5 wt %.

4. A method of manufacturing a product for coining, comprising the steps of:
obtaining a ferrous alloy through a batch melting process, the ferrous alloy consisting essentially of
4.00-9.85 wt % of Cr,
8.00-25.00 wt % of Ni,
3.00-6.00 wt % of Cu,
0.001-0.025 wt % of C,
0.50-2.00 wt % of Mn, 0.001-2 wt % of Si, and a balance of Fe and incidental impurities; and heating the ferrous alloy above 1800 degrees F.

5. The method of claim 4, further comprising the step of rolling a metal ingot of the ferrous alloy.

6. The method of claim 5, further comprising the step of punching a blank from the ferrous alloy.

7. The method of claim 6, further comprising the step of upsetting the blank to form a continuous raised rim along an edge thereof.

8. The method of claim 7, further comprising the step of surface preparing the ferrous alloy.

9. The method of claim 8, wherein the surface preparing is performed by grinding.

10. The method of claim 4, further comprising the step of heating the ferrous alloy above 2000 degrees F.

11. The method according to claim 4, wherein Ni is 14.50-15.50 wt %.

12. The method according to claim 4, wherein Cu is 4.5-5.5 wt %.

13. A ferrous alloy for coining, comprising:

7.05-8.5 wt % of chromium (Cr);

14.50-15.50 wt % of nickel (Ni);

3.00-6.00 wt % of copper (Cu); and a balance of iron (Fe) and incidental impurities.

14. The ferrous alloy according to claim 13, wherein Cu is 4.5-5.5 wt %.

15. The ferrous alloy according to claim 14, further comprising one or more additional elements from a group consisting of essentially C, Mn, or Si.

16. The ferrous alloy according to claim 15, wherein the one or more additional elements are optionally 0.001-0.025 wt % of C, 0.50-2.00 wt % of Mn, and 0.001-2 wt % of Si.

17. A method of manufacturing a product for coining, comprising the steps of:

obtaining a ferrous alloy through a batch melting process, the ferrous alloy comprising obtaining a ferrous alloy through a batch melting process, the ferrous alloy comprising 7.05-8.5 wt % of chromium (Cr), 14.50-15.50 wt % of nickel (Ni), 3.00-6.00 wt % of copper (Cu), and a balance of iron (Fe) and incidental impurities; and heating the ferrous alloy above 1800 degrees F.

18. The method of claim 17, further comprising the step of rolling a metal ingot of the ferrous alloy.

19. The method of claim 18, further comprising the step of punching a blank from the ferrous alloy.

20. The method of claim 19, further comprising the step of upsetting the blank to form a continuous raised rim along an edge thereof.

21. The method of claim 20, further comprising the step of surface preparing the ferrous alloy.

22. The method of claim 21, wherein the surface preparing is performed by grinding.

23. The method of claim 17, further comprising the step of heating the ferrous alloy above 2000 degrees F.

* * * * *